US006140109A

United States Patent [19]

McDevitt et al.

[11] Patent Number: 6,140,109

[45] Date of Patent: Oct. 31, 2000

[54] METHOD FOR ENZYMATIC TREATMENT OF WOOL

[75] Inventors: Jason Patrick McDevitt, Wake Forest, N.C.; Jacob Winkler, København S, Denmark

[73] Assignee: Novo Nordisk Biochem North America, Inc., Franklinton, N.C.

[21] Appl. No.: 09/159,182

[22] Filed: Sep. 23, 1998

Related U.S. Application Data

[63] Continuation-in-part of application No. 09/082,218, May 20, 1998, abandoned.

[51] Int. Cl.[7] ..... D06M 16/00

[52] U.S. Cl. ..... 435/263; 435/267; 8/112; 8/128.1

[58] Field of Search ..... 435/263, 267; 8/112, 127.5, 128.1

[56] References Cited

U.S. PATENT DOCUMENTS

| | | | |
|---|---|---|---|
| 5,458,810 | 10/1995 | Fredj et al. | 252/542 |
| 5,529,928 | 6/1996 | Ciampi et al. | 435/263 |

FOREIGN PATENT DOCUMENTS

| | | |
|---|---|---|
| 0 134 267 | 3/1985 | European Pat. Off. . |
| 0 358 386 | 3/1990 | European Pat. Off. . |
| WO 89/03909 | 5/1989 | WIPO . |
| WO 89/09813 | 10/1989 | WIPO . |
| WO 92/18683 | 10/1992 | WIPO . |
| WO 93/11226 | 6/1993 | WIPO . |
| WO 93/13193 | 7/1993 | WIPO . |
| WO 97/04102 | 2/1997 | WIPO . |
| WO 98/27264 | 6/1998 | WIPO . |

OTHER PUBLICATIONS

Abstract of JP–A 51099196.
English Translation of JP–A 3213574.
Heine et al., Rev. Prog, Coloration, vol. 25, pp. 57–63 (1995).
S. Fornelli, International Dyer,vol. 178, No. 10, pp. 31–33 (Oct. 1993).

*Primary Examiner*—David A. Redding
*Attorney, Agent, or Firm*—Steve T. Zelson; Valeta Gregg

[57] ABSTRACT

A method of treating wool, wool fibers or animal hair with a haloperoxidase (together with a hydrogen peroxide source and a halide source), and a proteolytic enzyme. The described method results in improved shrink-resistance, handle, appearance, wettability, reduction of felting tendency, increased whiteness, reduction of pilling, improved softness, tensile strength retention, improved stretch, improved burst strength, and improved dyeing characteristics such as dye uptake and dye washfastness. Furthermore, relative to treatments with proteolytic enzymes alone (no haloperoxidase), the described method results in reduced weight loss, reduced fiber damage, and improved burst strength.

20 Claims, No Drawings

METHOD FOR ENZYMATIC TREATMENT OF WOOL

CROSS-REFERENCE TO RELATED APPLICATIONS

This application is a continuation-in-part of application Ser. No. 09/082,218 filed on May 20, 1998, now abandoned, the contents of which are fully incorporated herein by reference.

FIELD OF THE INVENTION

The present invention relates to a method of treating wool, wool fibers or animal hair with a haloperoxidase (together with a hydrogen peroxide source and a halide source) and a proteolytic enzyme.

BACKGROUND OF THE INVENTION

Two major problems associated with wool are its tactile discomfort (itchiness) and tendency to shrink. Improvements in softness and handle of wool can be achieved by addition of various chemical agents such as silicone softeners or by addition of proteolytic enzymes. The cost of these improvements may be greater than the moderate benefits achieved. Changes in one property of wool can affect other properties, sometimes adversely. For example, protease treatments normally have adverse effects on strength and weight of wool material.

Methods to generate shrink-resistant wool are known. The most commonly used method is the IWS/CSIRO Chlorine Hercosett process, which comprises an acid chlorination of wool, followed by a polymer application. This process imparts a high degree of shrink-resistance to wool, but adversely affects the handle of wool, and generates environmentally damaging waste.

Methods to reduce shrinkage of wool which do not result in release of damaging substances to the environment have been suggested, including enzymatic processes as well as benign chemical processes such as low-temperature plasma treatments. Plasma treatment is a dry process which involves treating wool fiber material with electrical gas discharges (so-called plasma). At present, there are obstacles (cost, capacity, compatibility) to large-scale commercialization of a plasma treatment process.

Various enzymatic methods have been used to treat wool. JP-A 51099196 describes a process to treat wool fabrics with alkaline proteases. JP-A 3213574 describes a method to treat wool using transglutaminase (an enzyme naturally found in wool follicles from sheep) or a solution containing transglutaminase. WO 92/18683 describes a process for bleaching of dyed textiles comprising treatment with an enzyme exhibiting peroxidase activity or oxidase activity. WO 98/27264 describes a method for reducing the shrinkage of wool comprising contacting wool with an oxidase or a peroxidase solution under conditions suitable for reacting the enzyme with wool. U.S. Pat. No. 5,529,928 describes a process for obtaining a wool with a soft woolly handle and shrink-resistant properties by using an initial chemical oxidative step or an enzyme treatment (e.g. a peroxidase, a catalase, or a lipase) followed by a protease treatment, followed by heat treatment. EP 358386 A2 describes a method to treat wool which comprises a proteolytic treatment and one of or both an oxidative treatment (such as NaOCl) and a polymer treatment. EP 134267 describes a method for treating animal fibers with an oxidizing agent, followed by a proteolytic enzyme in a salt-containing composition.

The environmental and performance deficiencies associated with current industrial processes for wool treatment substantiate the need for novel processes that provide further improvements relating to shrink-resistance or softness. Enzymatic methods for treating wool, used alone or in conjunction with an oxidative chemical step, have had little commercial value, a fact that is attributable to their relatively high costs and their tendency to damage wool by causing weight and strength losses. There is a need for an improved enzymatic method to treat wool, wool fibers, or animal hair material which imparts improvements in softness, shrink-resistance, appearance, whiteness, dye uptake, and resistance to pilling, but causes less fiber damage than known enzymatic treatments.

SUMMARY OF THE INVENTION

The object of the present invention is to provide improved enzyme-based methods for treating wool, wool fibers or animal hair, in particular methods which provide advantages with regard to improved shrink-resistance, and/or improvements of softness and handle which are highly desired by the end-user, while minimizing fiber damage relative to existing degradative treatments of wool and other animal hair materials.

It has now been found that certain properties of wool, wool fibers or animal hair may be improved by subjecting wool or animal hair to a a haloperoxidase (together with a hydrogen peroxide source and a halide source) and a proteolytic enzyme in an amount effective for providing the desired effect.

Depending on the particular characteristics of the wool subjected to the treatment according to the present invention, the benefits resulting from this treatment can be improved shrink-resistance, improved handle, improved appearance, improved wettability, reduction of felting tendency, increased whiteness, reduction of pilling, improved softness, tensile strength retention, improved stretch, improved burst strength, and improved dyeing characteristics such as dye uptake and dye washfastness.

The invention thus relates to a method of treating wool, wool fibers or animal hair, comprising contacting the wool, wool fibers or animal hair in aqueous solution with a proteolytic enzyme, either simultaneously with or after treatment with haloperoxidase.

In a preferred embodiment, the method comprises treatment with haloperoxidase at a pH between 3.5 and 6.0, more preferably at a pH between 4.1 and 5.3, followed by treatment with a protease, preferably an alkaline protease. This combination imparts, inter alia, advantages with respect to improved shrink-resistance, handle, resistance to pilling, and dye uptake relative to untreated wool or wool treated with either haloperoxidase (or other oxidoreductases) or proteases. Furthermore, this combination reduces fiber damage (manifested by reductions in fabric weight loss and burst strength) relative to protease treatments without haloperoxidase pre-treatments, or protease treatments following pre-treatment with other oxidoreductases such as laccase, or protease treatments combined with haloperoxidase pre-treatments falling outside of the specified pH range.

In said preferred embodiment, the haloperoxidase pre-treatment enables and enhances the beneficial characteristics of a proteolytic step (i.e., improved shrink-resistance, softness, dye uptake), while also serving a protective function, reducing the major deleterious characteristic (i.e., fiber damage, resulting in material having reduced strength and weight) of said subsequent protease treatment.

In a further embodiment, the wool, wool fibers or animal hair may have undergone an oxidative pre-treatment prior to any of the enzymatic treatments described above. Examples of oxidative pre-treatments include acidic chlorination, DCCA, sodium hypochlorite, caroat, and permanganate.

In another aspect, the present invention further relates to wool or animal hair material that has been treated according to the method of the present invention. Other aspects of the invention will become apparent from the following detailed description and the claims.

DETAILED DESCRIPTION OF THE INVENTION

Before the methods of the invention are described, it is to be understood that this invention is not limited to the particular methods described. The terminology used herein is for the purpose of describing particular embodiments only, and is not intended to be limiting since the scope of the present invention will be limited only by the appended claims.

As used in this specification and the appended claims, the singular forms "a", "an", and "the" include plural references unless the context clearly dictates otherwise. Thus, for example, references to "proteolytic enzyme" or "proteolytic preparation" include mixtures of such proteolytic enzymes, reference to "the method" includes one or more methods, and/or steps of the type described herein and/or which will become apparent to those persons skilled in the art upon reading this disclosure and so forth.

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described. All publications mentioned herein are incorporated herein by reference for the purpose of disclosing and describing the material in connection with which the reference was cited.

Definitions

The term "shrinkage" refers to the felting shrinkage of fibers as defined in IWS TM 31, i.e., felting shrinkage is the irreversible shrinkage caused by progressive entanglement of the wool fibers induced by washing in an aqueous solution, and is defined as the reduction in length and/or width induced by washing. Shrinkage can be measured in accordance with IWS TM 31, or it can be measured using the following modification. Wool samples (24 cm×24 cm) are sewed around the edges and inscribed with a rectangle (18 cm×18 cm). Samples are treated, air-dried, then subjected to five cycles of machine washing and drying (warm wash, high heat of drying) in combination with external ballast such as towels and articles of clothing. The dimensions of the rectangle are measured after five cycles, and the shrinkage is defined as the change in dimensions of the rectangle, after accounting for initial relaxation shrinkage.

The term "shrink-resistance" is a measure of the reduction in shrinkage (as defined above, after wash/dry cycles) for material that has been treated relative to material that has not been treated, i.e., $$\text{Shrink-resistance}=(\text{Shrinkage}_{untreated}-\text{Shrinkage}_{treated})/\text{Shrinkage}_{treated}$$

The value is multiplied by 100 in order to be expressed as a percentage.

A reduction in shrinkage implies a reduction in felting, and thus all methods that provide improved shrink-resistance also provide "anti-felting" properties.

The term "handle" is a subjective term that refers to the sensation of touch or feel of a textile. The term "softness" is a subjective term referring to the feel of a textile, and is a component of handle.

The term "pilling" refers to the entangling of fibers into balls (pills), which are visible on the surface of a fabric. A pill is of sufficient density that it will cast a shadow. Resistance to pilling can be measured according to IWS Test Method 196, or can be inspected visually. Pilling is a major component of fabric appearance (along with other properties such as whiteness). Reduced pilling gives better appearance and improved resistance to pilling is implied herein wherever the term "superior appearance" is used.

The term "stretch" refers to the increase in length of a fibrous material when a fixed load is applied. In general, a higher value for stretch is preferred relative to a lower value. In the present context, the term "elongation" refers to the permanent increase in length (non-recoverable extension) of a fibrous material after application and removal of a fixed load. In general, a lower value for elongation is preferred relative to a higher value. Stretch and elongation have been measured in accordance with the following modification of IWS TM 179. Fabric strips (100 mm×55 mm rectangles, with the longer dimension in the weft direction) were placed in the jaws of a suitable tensile strength machine such as an Instron® 5564. The distance between the jaws was set at 60 mm, and the load was increased to 10N at a rate of extension of 100 mm/min. Once the desired load was reached, the direction of movement was immediately reversed, and the rate of contraction was equal to the rate of extension. Five cycles were performed. The extension after the first cycle was defined as the fabric "stretch", and the "elongation" was defined as the stretch after the fifth cycle relative to the stretch after the first cycle, i.e., $E=S_5/S_1$.

The term "whiteness" is intended to mean a optical determination of the extent of color on wool. Whiteness can be measured in Stensby units (W=L+3a−3b) on a suitable spectrophotometer such as the Macbeth Color-Eye® 7000.

The term "burst strength" refers to the pressure applied to a circular specimen in distending it to rupture. Burst strength can be measured (using a suitable apparatus such as the Mullen® tester from B. F. Perkins) in accordance with IWS TM 29, and can be performed on either wet or dry fabric.

The term "dyeing characteristics" refers to properties associated with dyeing of wool or animal hair material, including dye uptake and dye color fastness to wet alkaline contact (as defined in IWS TM 174). Dye uptake is a measure of the capacity of wool or animal hair material immersed in a dye solution to absorb available dyestuff. This property can be measured by the following test. In a suitable reaction vessel, wool or animal hair material is added to a buffered solution of acid black 172 (300 ml of 0.05 M NaOAc buffer, pH 4.5, plus 7.5 mL of a 1.0% w/w solution of acid black 172 in water). The vessel is incubated in a shaking water bath at 50° C. for 15 minutes with mild agitation. After removal of the material from solution, it is allowed to air-dry, then measured in a suitable spectrophotometer to determine CIELAB values. Dye uptake is determined by the L* reading, and changes in dye uptake are found by determining dL* relative to untreated material.

By the term "wool," "wool fiber," "animal hair," and the like, is meant any commercially useful animal hair product, for example, wool from sheep, camel, rabbit, goat, llama, and known as merino wool, shetland wool, cashmere wool, alpaca wool, mohair, etc.

The method of the invention can be used with wool or animal hair material in the form of top, fiber, yam, or woven or knitted fabric. The enzymatic treatment can also be carried out on loose flock or on garments made from wool or animal hair material. The treatment can be performed at many different stages of processing, including either before or after dyeing. A range of different chemical additives can be added along with the enzymes, including wetting agents and softeners.

It should be emphasized that wool and other animal hair materials are products of biological origin. The material may vary greatly, e.g., in chemical composition and morphological structure depending on the living conditions and health of the animal. Accordingly, the effect(s) obtained by subjecting wool or other animal hair products to the method of the present invention may vary in accordance with the properties of the starting material.

The Method of the Invention

It is contemplated that enzymatic treatments can take place either as stand-alone steps or in combination with other treatments such as scouring or dyeing of wool or animal hair material. In one embodiment of the invention, wool or animal hair material is subjected to treatment with a proteolytic enzyme either simultaneously with or subsequent to a haloperoxidase treatment. Further, chemical additives such as surfactants and softeners can be included in enzyme treatment steps, or in separate steps. Such treatments can produce wool textiles having a novel combination of physical properties, such as improved handle, shrink-resistance, and appearance while reducing strength losses and fiber damage commonly observed in degradative treatments of wool.

Treatment conditions. The haloperoxidase and proteolytic treatment steps are preferably carried out for a duration of at least 1 minute and less than 150 minutes; preferably at a temperature from about 15° C. to about 90° C., more preferably from about 20° C. to about 70° C., in particular from about 30° C. to about 55° C. Alternatively, the wool can be soaked in or padded with an aqueous treatment solution and then subjected to steaming at a conventional temperature and pressure. It is contemplated that the reaction rate of the enzyme treatment step can be increased by increasing the temperature of the enzyme bath during the treatment, i.e., the total treatment time can be reduced.

The enzyme treatment can be carried out in an acidic, neutral or alkaline medium, depending on the particular enzyme in question. The medium may include a buffer. It may be advantageous to carry out the enzyme treatment step in the presence of one or more conventional anionic, non-ionic or cationic surfactants. An example of a useful non-ionic surfactant is Dobanol (from Henkel AG).

The proteolytic enzyme treatment may be carried out simultaneously with or following the haloperoxidase treatment. In order to derive maximum benefits from a simultaneous treatment, the proteolytic enzyme must be active in the presence of hydrogen peroxide and should be active at a pH at which the haloperoxidase is also active. Therefore, for simultaneous use, an acidic protease is preferably paired with an acidic haloperoxidase. Alternatively, an alkaline protease could be paired with an alkaline haloperoxidase.

In a preferred embodiment, the proteolytic enzyme treatment is carried out after an initial haloperoxidase treatment. In a more preferred embodiment, the proteolytic enzyme is an alkaline protease such as Esperase® or Savinase®.

In a preferred embodiment, the proteolytic enzyme treatment is carried out after an initial haloperoxidase treatment within a pH range 3.5–6, even more preferably within a pH range of 4.1–5.3.

Haloperoxidase Treatment

In the context of the present invention, the term "haloperoxidase" is intended to mean an enzyme selected from the group consisting of chloride peroxidase (EC 1.11.1.10), bromide peroxidase, and iodide peroxidase (EC 1.11.1.8), or a combination of two or more such haloperoxidases. A chloride peroxidase is an enzyme capable of oxidizing chloride, bromide and iodide ions with the consumption of $H_2O_2$. A bromide peroxidase is an enzyme capable of oxidizing bromide and iodide ions with the consumption of $H_2O_2$. A iodide peroxidase is an enzyme capable of oxidizing iodide ions with the consumption of $H_2O_2$.

According to the invention, Vanadium haloperoxidases are preferred. Vanadium peroxidases are different from other haloperoxidases in that the prosthetic group in these enzymes have structural features similar to vanadate (vanadium V), whereas the other haloperoxidases are heme-peroxidases. The Vanadium haloperoxidases disclosed in WO 95/27046 are preferred.

Haloperoxidases form a class of enzymes which are able to oxidize halides (X=Cl—, Br—, or I—) in the presence of hydrogen peroxide to the corresponding hypohalous acid (HOX) according to:

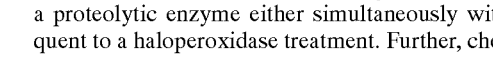

$$H_2O_2+X^-+H^+\rightarrow H_2O+HOX$$

Haloperoxidases have been isolated from various organisms: mammals, marine animals, plants, algae, a lichen, fungi and bacteria (see, for example (1993) *Biochim. Biophys. Acta* 1161:249–256). It is generally accepted that haloperoxidases are the enzymes responsible for the formation of halogenated compounds in nature, although other enzymes may be involved.

Haloperoxidases have been isolated from many different fungi, in particular from the fungus group dematiaceous hyphomycetes, such as Caldariomyces, e.g., *C. fumago, Alternaria, Curvularia*, e.g., *C. verruculosa* and *C. inaequalis*, Drechslera, Ulocladium and Botrytis (see U.S. Pat. No. 4,937,192).

According to the present invention, a haloperoxidase obtainable from Curvularia, in particular *C. verruculosa* is preferred such as *C. verruculosa* CBS 147.63 or *C. verruculosa* CBS 444.70. Curvularia haloperoxidase and recombinant production hereof is described in WO 97/04102.

Haloperoxidase has also been isolated from bacteria such as Pseudomonas, e.g., *P. pyrrocinia* (see, for example *The Journal of Biological Chemistry* 263, 1988, pp. 13725–13732) and Streptomyces, e.g., *S. aureofaciens* (see, for example, *Structural Biology* 1, 1994, pp. 532–537).

Bromide peroxidase has been isolated from algae (U.S. Pat. No. 4,937,192). The amount of haloperoxidase used is preferably in the range 0.001 g to 20 g, preferably in the range 0.01 g to 5 g, more preferably in the range 0.02 g to 2 g per kg wool, fiber, or hair.

Hydrogen Peroxide Sources

According to the invention, the hydrogen peroxide needed for the reaction with the haloperoxidase may be achieved in many different ways: it may be hydrogen peroxide or a hydrogen peroxide precursor, such as, e.g., percarbonate or perborate, or a peroxycarboxylic acid or a salt thereof, or it may be a hydrogen peroxide-generating enzyme system, such as, e.g., an oxidase and its substrate. Useful oxidases may be, e.g., a glucose oxidase, a glycerol oxidase or an amino acid oxidase. An example of an amino acid oxidase is given in WO 94/25574.

It may be advantageous to use enzymatically generated hydrogen peroxide, since this source results in a relatively low concentration of hydrogen peroxide under the biologically relevant conditions.

According to the invention, the hydrogen peroxide source needed for the reaction with the haloperoxidase-may be added in a concentration corresponding to a hydrogen peroxide concentration in the range of from 0.01–1000 mM, preferably in the range of from 0.1–500 mM, more preferably in the range 0.5–50 mM.

Halide Sources

According to the invention the halide source needed for the reaction with the haloperoxidase may be achieved in many different ways, e.g., by adding a halide salt: It may be sodium chloride, potassium chloride, sodium bromide, potassium bromide, sodium iodide, or potassium iodide.

The concentration of the halide source will typically correspond to 0.01–1000 mM, preferably in the range of from 0.1–500 mM.

Proteolytic Enzyme

A useful proteolytic enzyme for the method of the present invention is any enzyme having proteolytic activity at the actual process conditions, including a combination of two or more such enzymes. Thus, the enzyme may be a proteolytic enzyme of plant origin, e.g., papain, bromelain, ficin, or of animal origin, e.g. trypsin and chymotrypsin, or of microbial origin, i.e., bacterial or fungal origin or from yeasts. It is to be understood that any mixture of various proteolytic enzyme may be applicable in the process of the invention.

Also, any proteolytic enzyme variant can be used in the process of the present invention, wherein the term "variant" means an enzyme produced by an organism expressing a gene encoding a proteolytic enzyme, and wherein said gene has been obtained by mutation of a naturally occurring proteolytic enzyme gene, the mutation being of either random or site-directed nature, including the generation of the mutated gene through gene shuffling.

In a preferred embodiment of the invention, the proteolytic enzyme is a serine-protease, a metallo-protease, or an aspartate-protease. A serine protease is an enzyme that catalyzes the hydrolysis of peptide bonds, and contain an essential serine residue at the active site (White, Handler and Smith, 1973 "Principles of Biochemistry," Fifth Edition, McGraw-Hill Book Company, N.Y., pp. 271–272). They are inhibited by diisopropylfluorophosphate, but in contrast to metalloproteases, are resistant to ethylene diamino tetraacetic acid (EDTA) (although they are stabilized at high temperatures by calcium ions). Serine proteases hydrolyze simple terminal esters and are similar in activity to eukaryotic chymotrypsin, also a serine protease. A more narrow term, alkaline protease, covering a sub-group, reflects the high pH optimum of some of the serine proteases, from pH 9.0 to 11.0. The serine proteases usually exhibit maximum proteolytic activity in the alkaline pH range, whereas the metallo-proteases and the aspartate-proteases usually exhibit maximum proteolytic activity in the neutral and the acidic pH range, respectively.

A sub-group of the serine proteases is commonly designated the subtilases (Siezen et al., *Protein Engng.* 4 (1991) 719–737). They are defined by homology analysis of more than 40 amino acid sequences of serine proteases previously referred to as subtilisin-like proteases. A subtilisin was previously defined as a serine protease produced by Gram-positive bacteria or fungi, and according to Siezen et al., now is a subgroup of the subtilases. The amino acid sequences of a number of subtilases have been determined, including at least six subtilases from Bacillus strains, namely, subtilisin 168, subtilisin BPN', subtilisin Carlsberg, subtilisin DY, subtilisin amylosacchariticus, and mesentericopeptidase, one subtilisin from an actinomycetales, thermitase from *Thermoactinomyces vulgaris*, and one fungal subtilisin, proteinase K from *Tritirachium album*. The long time recognized group of serine proteases, the subtilisins, have according to this more recent grouping been divided into two sub-groups. One subgroup, I-S1, comprises the "classical" subtilisins, such as subtilisin 168, subtilisin BPN', subtilisin Carlsberg (ALCALASE®, Novo Nordisk A/S), and subtilisin DY. The other subgroup, I-S2, is described as highly alkaline subtilisins and comprise enzymes such as subtilisin PB92 (MAXACAL®, Genencor International, Inc.), subtilisin 309 (SAVINASE®, Novo Nordisk A/S), subtilisin 147 (ESPERASE®, Novo Nordisk A/S), and alkaline elastase YaB.

These subtilisins of group I-S2 and variants thereof constitute a preferred class of proteases which are useful in the method of the invention. An example of a useful subtilisin variant is a variant of subtilisin 309 (SAVINASE®) wherein, in position 195, glycine is substituted by phenylalanine (G195F or $^{195}$Gly to $^{195}$Phe).

Conveniently, conventional fermented commercial proteases are useful. Examples of such commercial proteases are Alcalase® (produced by submerged fermentation of a strain of *Bacillus licheniformis*), Esperase® (produced by submerged fermentation of an alkalophilic species of Bacillus), Rennilase® (produced by submerged fermentation of a non-pathogenic strain of *Mucor miehei*), Savinase® (produced by submerged fermentation of a genetically modified strain of Bacillus), e.g., the variants disclosed in the International Patent Application published as WO 92/19729, and Durazym® (a protein-engineered variant of Savinase®). All the mentioned commercial proteases are produced and sold by Novo Nordisk A/S, DK-2880 Bagsvaerd, Denmark. Other preferred serine proteases are proteases from Nocardiopsis, Aspergillus, Rhizopus, *Bacillus alcalophilus, B. cereus, N. natto, B. vulgatus, B. mycoide*, and subtilins from Bacillus, especially proteases from the species Nocardiopsis sp. and *Nocardiopsis dassonvillei* such as those disclosed in the International Patent Application published as WO 88/03947, especially proteases from the species Nocardiopsis sp., NRRL 18262, and *Nocardiopsis dassonvillei, NRRL* 18133. Yet other preferred proteases are the serine proteases from mutants of Bacillus subtilins disclosed in the International Patent Application Nos. PCT/DK89/00002 and PCT/DK97/00500, and in the International Patent Application published as WO 91/00345, and the proteases disclosed in EP 415 296 A2.

Another preferred class of proteases are the metalloproteases of microbial origin. Conveniently, conventional fermented commercial proteases are useful. An example of such a commercial protease is Neutrase® (Zn) (produced by submerged fermentation of a strain of *Bacillus subtilis*), which is produced and sold by Novo Nordisk A/S, DK-2880 Bagsvaerd, Denmark.

Other useful commercial protease enzyme preparation are Bactosol™ WO and Bactosol™ SI, available from Sandoz AG, Basle, Switzerland; Toyozyme™, available from Toyo Boseki Co. Ltd., Japan; and Proteinase K™ (produced by submerged fermentation of a strain of Bacillus sp. KSM-K16), available from Kao Corporation Ltd., Japan.

The amount of proteolytic enzyme used is preferably in the range 0.001 g to 20 g, preferably in the range 0.01 g to 10 g, more preferably in the range 0.05 g to 5 g per kg wool, fiber, or hair.

Softeners

It may be desirable to treat the wool or animal hair material with a softening agent, either simultaneously with or after enzymatic treatments. The softeners conventionally used on wool are usually cationic softeners, either organic cationic softeners or silicone-based products, but anionic or non-ionic softeners are also useful. Examples of useful softeners are polyethylene softeners and silicone softeners, i.e., dimethyl polysiloxanes (silicone oils), H-polysiloxanes, silicone elastomers, aminofunctional dimethyl polysiloxanes, aminofunctional silicone elastomers, and epoxyfunctional dimethyl polysiloxanes, and organic cationic softeners, e.g., alkyl quaternary ammonium derivatives.

The invention is further illustrated in the following non-limiting examples.

EXAMPLES

Example 1

Treatment with Haloperoxidase and Savinase

Two swatches (24 cm×24 cm, with 18×18 $cm^2$ rectangle inscribed on each, approximately 9 g each) of jersey knit wool (TestFabrics TF532) were sewn around the edges. The swatches were immersed in 500 ml of a 25 mM sodium acetate buffer containing 10 mM NaCl and 10 mM hydrogen peroxide, pH 5, and treated with *Curvtilaria verruculosa* haloperoxidase (3.3 mg pure enzyme) for 50 minutes at 40° C. in an incubating shaker bath. After 30 minutes, sufficient hydrogen peroxide was added to boost the depleted peroxide concentration by 5 mM. Samples were rinsed and allowed to air-dry, then placed in separate Launder-O-meter beakers containing 250 ml of a 0.04 M Tris buffer, pH 8.25 at 25° C., containing 5 mM calcium chloride. A solution of SAVINASE® 16.0L (200 ml) was added to the vessels, which were then placed in the Launder-O-meter and allowed to react for 40 minutes at 44° C., followed by a ten minute heating gradient up to 80° C., then held at that temperature for ten minutes to inactivate the enzyme. The sample was removed from the solution, rinsed, dried, and measured, then subjected to five cycles of machine washing and drying, before being subjected to further property testing.

Example 2

Treatment with Haloperoxidase and Esperase

Two swatches (24 cm×24 cm, with 18×18 $cm^2$ rectangle inscribed on each, approximately 9 g each) of jersey knit wool (TestFabrics TF532) were sewn around the edges. The swatches were immersed in 500 ml of a 25 mM sodium acetate buffer containing 10 mM NaCl and 10 mM hydrogen peroxide, pH 5, and treated with *Curvularia verruculosa* haloperoxidase (3.3 mg pure enzyme) for 50 minutes at 40° C. in an incubating shaker bath. After 30 minutes, sufficient hydrogen peroxide was added to boost the depleted peroxide concentration by 5 mM. Samples were rinsed and allowed to air-dry, then placed in separate Launder-O-meter beakers containing 250 ml of a 0.04 M Tris buffer, pH 8.25 at 25° C., containing 5 mM calcium chloride. A solution of ESPERASE® 8.0L (200 ml) was added to the vessels, which were then placed in the Launder-O-meter and allowed to react for 40 minutes at 44° C., followed by a ten minute heating gradient up to 80° C., then held at that temperature for ten minutes to inactivate the enzyme. The sample was removed from the solution, rinsed, dried, and measured, then subjected to five cycles of machine washing and drying, before being subjected to further property testing.

Example 3

Weight Loss, Burst Strength, and Shrinkage of Wool Treated with Protease Following Haloperoxidase Treatment Wool swatches were subjected to an initial pre-treatment step using either a haloperoxidase treatment or a water blank. The samples were thoroughly rinsed, wrung dry, then subjected to a second treatment, this one consisting of a protease or blank treatment at pH 8.1. The samples were then subjected to five machine wash/dry cycles, equilibrated in a constant temperature and humidity room, then tested.

Experimental Conditions:

Material: Wool swatches (jersey knit wool—TestFabrics TF532), 24 cm×24 cm, with 18×18 $cm^2$ rectangle inscribed on each, approximately 9 g each, sewn around the edges.

Pre-treatment Conditions: Two swatches incubated in 500 mL distilled water or specified buffer (0.05 M citric acid buffer, pH 3.5, 3.9, 4.3, 4.7, 5.1, or 5.5), in Launder-O-Meter, for 45 minutes at 40° C.

Haloperoxidase Pre-treatment Conditions: *Curvularia verruculosa* haloperoxidase, approximately 8 mg enzyme protein per liter, 10 mM hydrogen peroxide, 10 mM NaCl.

Proteolytic Enzyme Treatment Conditions: Two swatches incubated in 500 mL buffer (40 mM Tris, pH 8.1 at 25° C.) containing 0.4 mL Esperase 8.0L in a Launder-O-Meter reaction vessel, for 40 minutes at 44° C., ramped up to 80° C. over ten minutes, then held at 80° C. for ten minutes.

| Sample | Haloperoxidase | pH (pre-treat) | Protease | Weight Loss (%) | Burst Strength (lb/sq. in.) | Shrinkage (%) | S.R. (%) |
|---|---|---|---|---|---|---|---|
| 1 | None | 7 | None | 0 | 34.5 | 32 | — |
| 2 | None | 7 | Esperase | 2.6 | 33.6 | 22 | 31 |
| 3 | *C. verruculosa* | 3.5 | Esperase | 1.0 | 34.4 | 30 | 7 |
| 4 | *C. verruculosa* | 3.9 | Esperase | 1.2 | 35.0 | 24 | 23 |
| 5 | *C. verruculosa* | 4.3 | Esperase | 1.3 | 35.2 | 19 | 39 |
| 6 | *C. verruculosa* | 4.7 | Esperase | 1.4 | 35.2 | 21 | 33 |
| 7 | *C. verruculosa* | 5.1 | Esperase | 1.5 | 34.5 | 20 | 39 |
| 8 | *C. verruculosa* | 5.5 | Esperase | 1.7 | 35.2 | 24 | 23 |

Note:
All values represent the average of two identically-treated samples. S.R. stands for shrink-resistance, and is calculated relative to the shrinkage of sample 1. Weight loss is measured after five wash-dry cycles, and is adjusted to compensate for small fluctuations in temperature and humidity (in a constant temperature and humidity room) such that the weight loss of sample 1 (control sample, water blank pre-treatment, Tris-buffered blank second treatment) is adjusted to be zero.Shrinkage is measured after five machine wash/dry cycles as described previously. Burst strength is a measure of the wet burst strength of the wool fabric, with several tests per swatch.

Samples treated with haloperoxidase prior to protease treatment had less fiber damage, as manifested in the weight loss and burst strength data, relative to samples that did not receive the haloperoxidase pre-treatment. Shrink-resistance was affected by the pH of haloperoxidase pre-treatment.

Samples pre-treated with haloperoxidase in the pH range 4.3–5.1 showed (i) an area shrinkage not exceeding 21%, (ii) an area shrinkage less than that conferred by treatment with protease alone, (iii) a loss of weight, compared with untreated wool, of less than 2%, and (iv) a loss of weight less than that conferred by treatment with protease alone.

Example 4

Treatment with Peroxidase/Laccase and Savinase

Wool swatches were subjected to an initial pre-treatment step using either an enzyme treatment in buffer or a buffer blank. The samples were thoroughly rinsed, wrung dry, then subjected to a second treatment consisting of a protease or blank treatment at pH 8.3. The samples were subjected to five machine wash/dry cycles, equilibrated in a constant temperature and humidity room, then tested for physical properties.

Experimental Conditions:

Material: Wool swatches (jersey knit wool—TestFabrics TF532), 24 cm×24 cm, with 18×18 $cm^2$ rectangle inscribed on each, approximately 9 g each, sewn around the edges.

Pre-treatment Conditions: Two swatches incubated in 500 mL buffer (25 mM acetate, pH 6.0) for one hour at 50° C.

Laccase Pre-treatment: *Myceliophthora thermophila* laccase, 1695 LamU/L buffered solution.

Peroxidase Pre-treatment: Coprinus sp. peroxidase, 2437 PoxU/L buffered solution, 0.15 mM hydrogen peroxide.

Proteolytic Enzyme Treatment Conditions: One swatch incubated in 250 mL buffer (40 mM Tris, pH 8.3) containing 0.2 mL Savinase 16.0L in a Launder-O-Meter reaction for 40 minutes at 44° C., ramped up to 80° C. over ten minutes, then held at 80° C. for ten minutes.

| Sample | Pre-treat Enzyme | Proteolytic Enzyme | Weight Loss (%) | Burst Strength (lb./sq. in) | Shrinkage (%) | S.R. (%) |
|---|---|---|---|---|---|---|
| 1 | None | None | 0 | 56 | 37 | — |
| 2 | None | Savinase | 4.4 | 53 | 25 | 33 |
| 3 | Laccase | None | 0 | 54 | 35 | 2 |
| 4 | Laccase | Savinase | 4.5 | 53 | 26 | 29 |
| 5 | Peroxidase | None | (+0.5) | 55 | 36 | 1 |
| 6 | Peroxidase | Savinase | 5.1 | 52 | 27 | 28 |

Note:

S.R. stands for shrink-resistance, and is calculated relative to the shrinkage of sample 1. Weight loss is measured after five wash-dry cycles, and is adjusted to compensate for small fluctuations in temperature and humidity (in a constant temperature and humidity room) such that the weight loss of sample 1 (control sample, water blank pre-treatment, Tris-buffered blank second treatment) is adjusted to be zero. Shrinkage is measured after five wash-dry cycles as described previously.Burst strength for these samples was the dry burst strength of the fabric.

Samples treated with oxidoreductases such as laccase or peroxidase prior to protease yielded no clear advantages relative to samples treated only with protease. In particular, the laccase and peroxidase pre-treatments did not enhance the shrink-resistance imparted by protease treatment, nor did the pre-treatments provide an effective protective function, as was observed in Example 1 for haloperoxidase pre-treatments.

We claim:

1. A method of improving shrink-resistance and softness of wool, wool fibers or animal hair, comprising contacting the wool, fibers or hair in aqueous solution with an effective amount of (i) a haloperoxidase together with a hydrogen peroxide source and a halide source, at a pH of about 3.5–5.5, and (ii) a proteolytic enzyme.

2. The method of claim 1, wherein the wool, wool fiber, or animal hair is treated with a proteolytic enzyme simultaneously with or following treatment with haloperoxidase.

3. The method of claim 1, wherein the haloperoxidase is obtainable from a fungus selected from the group consisting of Caldariomyces, Alternaria, Curvularia, Drechslera, Ulocladium and Botrytis.

4. The method of claim 3, wherein the haloperoxidase is obtainable from Curvularia.

5. The method of claim 4, wherein the haloperoxidase is obtainable from Curvularia verruculosa.

6. The method of claim 1, wherein the haloperoxidase is obtainable from a bacterium selected from the group consisting of Pseudomonas and Streptomyces.

7. The method of claim 3, wherein the haloperoxidase is a Vanadium haloperoxidase.

8. The method of claim 3, wherein the haloperoxidase is a chloride peroxidase.

9. The method of claim 1, wherein the source of hydrogen peroxide is hydrogen peroxide, or a hydrogen peroxide precursor.

10. The method of claim 9, wherein the hydrogen peroxide precursor is percarbonate or perborate.

11. The method of claim 1, wherein the halide source is a halide salt.

12. The method of claim 11, wherein the halide source is sodium chloride, potassium chloride, sodium bromide, potassium bromide, sodium iodide, or potassium iodide.

13. The method of claim 1, wherein the amount of haloperoxidase used per kg wool, fiber, or hair is in the range 0.001 g to 10 g.

14. The method of claim 1, wherein the proteolytic enzyme is of plant, animal, bacterial, or fungal origin.

15. The method of claim 14, wherein the proteolytic enzyme is selected from the group consisting of papain, bromelain, ficin, and trypsin.

16. The method of claim 14, wherein the proteolytic enzyme is a serine protease.

17. The method of claim 16, wherein the serine protease is a subtilisin derived from Bacillus or Tritirachium.

18. The method of claim 1, wherein the amount of protease used per kg wool, fiber, or hair is in the range 0.001 g to 10 g.

19. The method of claim 1, wherein the aqueous solution additionally comprises a softening agent.

20. The method of claim 1, wherein the wool, wool fibers or animal hair are treated with a softening agent after the haloperoxidase and protease treatment.

* * * * *